US005366518A

United States Patent [19]

DeRosa et al.

[11] Patent Number: 5,366,518

[45] Date of Patent: * Nov. 22, 1994

[54] MOTOR FUEL ADDITIVE AND FUEL COMPOSITION

[75] Inventors: Thomas F. DeRosa, Passaic, N.J.; Joseph M. Russo, Poughkeepsie, N.Y.; Rodney L. Sung, Fishkill, N.Y.; Benjamin J. Kaufman, Hopewell Junction, N.Y.

[73] Assignee: Texaco Inc., White Plains, N.Y.

[ * ] Notice: The portion of the term of this patent subsequent to Nov. 6, 2007 has been disclaimed.

[21] Appl. No.: 812,484

[22] Filed: Dec. 23, 1991

[51] Int. Cl.[5] ..... C10L 1/22

[52] U.S. Cl. ..... 44/331; 44/437; 548/556; 528/421; 528/340

[58] Field of Search ..... 44/331, 437; 525/409; 528/421, 340; 548/556

[56] References Cited

U.S. PATENT DOCUMENTS 3,806,456 4/1974 Vogel ..... 44/331
4,581,038 4/1986 Hoke ..... 44/331
4,810,261 3/1989 Sung et al. ..... 44/331
4,852,993 8/1989 Sung et al. ..... 44/331
4,968,321 11/1990 Sung et al. ..... 44/331

*Primary Examiner*—Jacqueline V. Howard
*Attorney, Agent, or Firm*—James J. O'Loughlin; Robert B. Burns

[57] ABSTRACT

A motor fuel additive composition comprising the imide reaction product of a hydrocarbyl-substituted dibasic acid anhydride and a random backbone polyoxyalkylene diamine having the formula:

in which R′ represents hydrogen or an alkyl radical having from 1 to 2 carbon atoms and the random backbone polyoxyalkylene radical consists of from about 5 to 65 weight percent of ethylene oxide and n has a value from 5 to 200 and a haze and emulsion resistant and ORI-inhibited motor fuel composition is provided.

15 Claims, 1 Drawing Sheet

MOTOR FUEL ADDITIVE AND FUEL COMPOSITION

BACKGROUND OF THE INVENTION

1. Field of the Invention

This invention relates to a novel reaction product additive composition for use in motor fuels. The additive comprises the imide reaction product obtained by reacting a hydrocarbyl-substituted dibasic acid anhydride with a random backbone polyoxyalkylene diamine to produce a motor fuel-soluble bisimide which provides a number of valuable properties in a motor fuel composition.

The combustion of a hydrocarbon motor fuel in an internal combustion engine leads to the formation and accumulation of deposits on various parts of the combustion chamber as well as on the fuel intake and exhaust system of the engine. The presence of deposits in the combustion chamber seriously reduces the operating efficiency of the engine. First, deposit accumulation within the combustion chamber inhibits heat transfer between the chamber and the engine cooling system. This leads to higher temperatures within the combustion chamber, resulting in increases in the end gas temperature of the incoming charge. Consequently, end gas auto-ignition occurs, which causes engine knock. In addition, the accumulation of deposits within the combustion chamber reduces the volume of the combustion zone, causing a higher than design compression ratio in the engine. This, in turn, can also lead to engine knocking. A knocking engine does not effectively utilize the energy of combustion. Moreover, a prolonged period of engine knocking can cause stress fatigue and wear in pistons, connecting rods, bearings and cam rods of the engine. The phenomenon noted is characteristic of gasoline powered internal combustion engines. It may be overcome by employing a higher octane gasoline which resists knocking for powering the engine. This need for a higher octane gasoline as mileage accumulates has become known as the engine octane requirement increase (ORI) phenomenon. It is particularly advantageous if engine ORI can be substantially reduced or eliminated by preventing or modifying deposit formation in the combustion chambers of the engine.

Another problem common to internal combustion engines relates to the accumulation of deposits in the carburetor. These deposits tend to restrict the flow of air through the carburetor at idle and at low speed resulting in an over-rich fuel mixture. This condition also promotes incomplete fuel combustion and may lead to rough engine idling and even engine stalling. This condition leads to the production of excessive hydrocarbon and carbon monoxide exhaust emissions. It would therefore be desirable from the standpoint of engine operability and overall air quality to provide a motor fuel composition which minimizes or overcomes the above-described problems.

A third problem common to internal combustion engines is the formation of intake valve deposits. Intake valve deposits interfere with valve closing and eventually result in valve burning. Such deposits interfere with valve motion and valve seating and tend to reduce the volumetric efficiency of the engine and to limit maximum power. Valve deposits may be produced from thermally and oxidatively unstable fuel or from lubricating oil oxidation products. The hard carbonaceous deposits produced collect in the tubes and runners that are part of the exhaust gas recirculation (EGR) flow. These deposits are believed to be formed from exhaust particles which are subjected to rapid cooling while mixing with the air-fuel mixture. Reduced EGR flow can result in engine knock and in nitric oxide, $NO_x$, emission increases. It would therefore be desirable to provide a motor fuel composition which minimizes or overcomes the formation of intake valve deposits.

An essential property of a motor fuel additive relates to its sensitivity to water. Motor fuels, in general, may Interface with or be mixed with water in the fuel distribution system. This problem commonly occurs in tank farm storage tanks as well as in underground service station storage tanks. To a limited extent, water may be present in vehicle fuel tanks. Additives that are highly sensitive to water tend to form an insoluble dispersion in the fuel, producing a hazy or cloudy fuel. In the presence of the fuel and water, the additive may also form a significant amount of a distinct thick emulsion layer in the fuel bottoms. The formation of a dispersion and of an emulsion layer in the fuel represents a loss of the normally soluble additive from its intended use in the fuel and may substantially diminish the properties of the fuel product. The formation of a distinct emulsion is more significant since it may interfere with the proper operation of engine fuel injectors because of the fine tolerances of their metering systems. It is highly desirable to provide an additive that is resistant to the formation of haze and an emulsion in the presence of water.

2. Disclosure Statement

U.S. Pat. No. 4,747,851 discloses a novel polyoxyalkylene diamine compound of the formula:

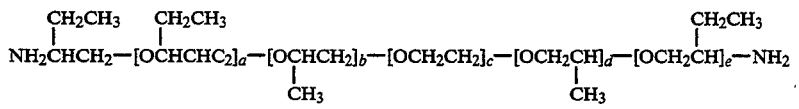

where c has a value from about 5–150, b+d has a value from about 5–150, and a+e has a value from about 2–12. Motor fuel compositions comprising the novel polyoxyalkylene diamine, alone or in combination with a polymer/copolymer additive are also disclosed.

U.S. Pat. No. 4,659,337 discloses the use of the reaction product of maleic anhydride, a polyether polyamide containing oxyethylene and oxypropylene ether moleties, and a hydrocarbyl polyamine in a gasoline motor fuel to reduce engine ORI and provide carburetor detergency.

U.S. Pat. No. 4,659,336 discloses the use of the mixture of (i) the reaction product of maleic anhydride, a polyether polyamine containing oxyethylene and oxypropylene ether moieties and a hydrocarbyl polyamine, and (ii) a polyolefin polymer/copolymer as an additive in motor fuel compositions to reduce engine ORI.

U.S. Pat. No. 4,631,069 discloses an alcohol-containing motor fuel composition which additionally comprises an antiwear additive which is the reaction product of a dibasic acid anhydride, a polyoxyisopropylene diamine of the formula:

$$NH_2-\underset{\underset{CH_3}{|}}{CH}-CH_2-(OCH_2-\underset{\underset{CH_3}{|}}{CH})_x-NH_2$$

where x has a value of 2–68, and an n-alkyl-alkylene diamine.

U.S. Pat. No. 4,643,738 discloses a motor fuel composition comprising a deposit-control additive which is the reaction product of a dibasic acid anhydride, a polyoxyisopropylene diamine of the formula:

$$NH_2-\underset{\underset{CH_3}{|}}{CH}-CH_2-(OCH_2-\underset{\underset{CH_3}{|}}{CH})_x-NH_2$$

where x has a value of 2–50, and an n-alkyl-alkylene diamine.

U.S. Pat. No. 4,604,103 discloses a motor fuel deposit control additive for use in internal combustion engines which maintains cleanliness of the engine intake system without contributing to combustion chamber deposits or engine ORI. The additive disclosed is a hydrocarbyl polyoxyalkylene polyamine ethane of molecular weight range 300–2,500 having the formula:

$$R-(OCH_2\underset{\underset{R'}{|}}{CH})_x-OCH_2CH_2-NR''R'''$$

where R is a hydrocarbyl radical of from 1 to about 30 carbon atoms; R′ is selected from methyl and ethyl; x is an integer from 5 to 30, and R″ and R‴ are independently selected from hydrogen and $-(CH_2CH_2NH)_y-H$, where y is an integer from 0 to 5.

U.S. Pat. No. 4,581,040 discloses the use of a reaction product as a deposit inhibitor additive in fuel compositions. The reaction product is the condensation product of the process comprising (i) reacting a dibasic acid anhydride with a polyoxyisopropylene diamine of the formula:

$$NH_2-\underset{\underset{CH_3}{|}}{CH}-CH_2-(OCH_2-\underset{\underset{CH_3}{|}}{CH})_x-NH_2$$

where x is a numeral of about 2–50, thereby forming a bis-maleamic acid; (ii) reacting said maleamic acid with a polyalkylene polyamine, thereby forming a condensate product; and (iii) recovering said condensate product.

Motor fuel compositions which contain amine additives to control deposition include the following:

U.S. Pat. No. 4,357,148 discloses a motor fuel additive useful in controlling ORI which is the combination of (a) an oil-soluble aliphatic polyamine containing at least one olefinic polymer chain, and (b) a polymer, copolymer, or corresponding hydrogenated polymer or copolymer of a $C_2$–$C_6$mono-olefin with a molecular weight of 500–1,500.

An object of this invention is to provide a novel additive reaction product which may be employed as an ORI-reducing additive in a motor fuel composition.

Another object is to provide a fuel additive reaction product having a novel random backbone polyoxyalkylene radical in its structure.

Another object of this invention is to provide a fuel additive which exhibits a reduced sensitivity to tank water bottoms and which substantially reduces the formation of haze in a motor fuel and reduces the formation of an opaque emulsion.

Another object of this invention is to provide a motor fuel composition which is deposit-resistant and exhibits ORI-inhibition when employed in an internal combustion engine.

Yet another object of this invention is to provide a concentrate composition which may be added to a motor fuel to provide motor fuel compositions of the instant invention.

Figure 1:
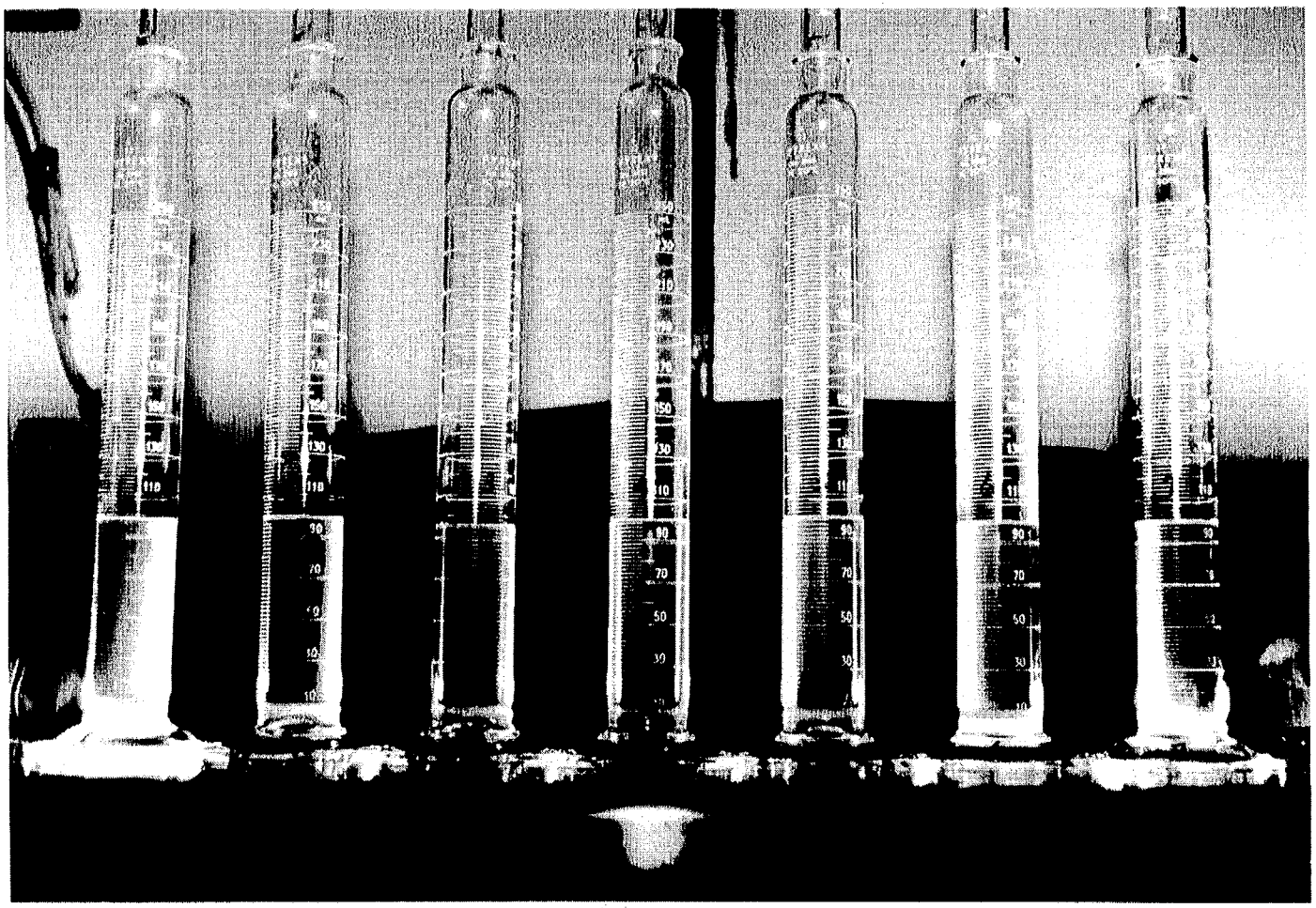
FIG. 1 is a photograph of seven exhibits of motor fuel, six of which have been treated with additives and one of which was untreated. The exhibits illustrated in FIG. 1 were photographed after standing for four hours following a vigorous mixing of the fuel and water.

Exhibit 1 shows a commercial motor fuel composition in which the additive contains the bisimide of a block copolymer in which the copolymer consists of approximately 50 weight percent ethylene oxide block, with the remainder being substantially propylene oxide blocks.

Exhibit 2 shows a similar motor fuel composition in which the additive contains the bisimide of a random backbone copolymer of ethylene oxide and propylene oxide in which the backbone copolymer was prepared using weight ratios of 7% ethylene oxide and 93% propylene oxide.

Exhibit 3 is similar to Sample 2, except that the random backbone copolymer was prepared using weight ratios of 15% ethylene oxide and 85% propylene oxide.

Exhibit 4 is similar to Sample 2, except that the random backbone copolymer was prepared using weight ratios of 25% ethylene oxide and 75% propylene oxide.

Exhibit 5 is similar to Sample 2, except that the random backbone copolymer was prepared using weight ratios of 40% ethylene oxide and 60% propylene oxide.

Exhibit 6 is similar to Sample 2, except that the random backbone copolymer was prepared using weight ratios of 60% ethylene oxide and 40% propylene oxide.

Exhibit 7 is a sample of unleaded base motor fuel containing no additives.

SUMMARY OF THE INVENTION

The ORI-inhibiting and water and emulsion resistant additive of the invention is the imide reaction product prepared by reacting a hydrocarbyl-substituted dibasic acid anhydride and a random backbone polyoxyalkylene diamine. Those skilled in the art are cognizant of the existence of blocks and micro-blocks of monomer incorporation in random copolymers. Adjusting the copolymerization temperature to generate near-identical monomer reactivity ratios promotes statistically random monomer incorporation. The hydrocarbyl-substituted dibasic acid anhydride reactant used to prepare the reaction product additive of the instant invention may be represented by the formula:

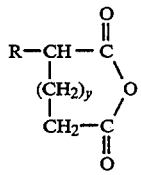

where R is a hydrocarbyl radical having a molecular weight in the range of 500–3,500 and y has a value of 0–2.

The random backbone polyoxyalkylene diamine reactant used to prepare the reaction product component of the invention is a diamine of the formula:

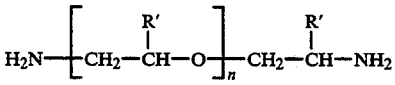

in which R′ represents hydrogen or an alkyl radical having from 1 to 2 carbon atoms and the random backbone polyoxyalkylene radical consists of from about 5 to 65 weight percent of ethylene oxide and n has a value from 5 to 200.

The motor fuel composition of the invention comprises a mixture of hydrocarbons in the gasoline boiling range and a minor amount of the prescribed ORI-inhibiting and emulsion resistant additive of the invention.

DETAILED DESCRIPTION OF THE INVENTION

The ORI-inhibiting and water and emulsion resistant additive of the invention is the imide reaction product prepared by reacting a hydrocarbyl-substituted dibasic acid anhydride and a random backbone polyoxyalkylene diamine. The hydrocarbyl-substituted dibasic acid anhydride reactant used to prepare the reaction product additive of the instant invention may be represented by the formula:

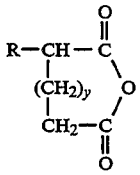

where R is a hydrocarbyl radical having a molecular weight in the range of 500–3,500 and y has a value of 0–2.

The hydrocarbyl radical represented by R is preferably a polypropenyl or polybutenyl radical and, most preferably, a polyisobutenyl radical having a molecular weight in the range of 500–3,500, with a preferred molecular weight range of 500–2,500, and still more particularly a molecular weight of 600–1,500, and most particularly a molecular weight of from about 800–1,200, and y is preferably 0. The molecular weight is determined as number average molecular weight. A preferred reactant is a hydrocarbyl-substituted succinic anhydride prepared from a suitable olefin and maleic anhydride.

The random backbone polyoxyalkylene diamine reactant used to prepare the reaction product of the invention is a diamine of the formula:

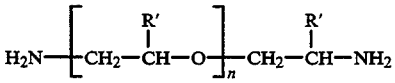

in which R′ represents hydrogen or an alkyl radical having from 1 to 2 carbon atoms and the random backbone polyoxyalkylene radical consists of from about 5 to 65 weight percent ethylene oxide and n has a value from 5 to 200.

A preferred diamine is one in which the polyoxyalkylene radical consists of from about 10 to 60 weight percent ethylene oxide and n has a value of 10 to 150, preferably 25 to 125. A still more preferred diamine is one in which the random backbone polyoxyalkylene radical consists of from about 10 to 40 weight percent ethylene oxide and n has a value from 40 to 100.

The prescribed random backbone polyoxyalkylene diamine reactant may be obtained by first preparing a random backbone polyoxyalkylene diol and thereafter catalytically aminating the polyol to produce the random backbone polyoxyalkylene diamine. The random backbone polyol precursor may be prepared by reacting a glycol with an aqueous alkali metal hydroxide in a closed reactor under a nitrogen gas purge. The reaction mixture is heated to about 95° C. to 120° C. to remove all of the water. A suitable mixture of ethylene oxide and propylene oxide and/or butylene oxide is then charged into the reactor. Alternatively, separate streams of ethylene oxide and propylene oxide and/or butylene oxide may be simultaneously charged to the reactor. This mixture is reacted at a temperature of 95° C. to 120° C. under a pressure of from 10 to 100 psig. After a digestion period, the alkaline random backbone polyol reaction product is neutralized. After neutralization, a stabilizer, such as di-t-butyl-p-cresol, is added to stabilize the product which is thereafter stripped and filtered to yield the final random backbone polyol precursor.

Amination of the above-described polyol precursor is accomplished as follows: A tubular reactor is filled with a catalyst, such as a nickel-chromium-copper metal oxide catalyst. The reactor is heated to a temperature in the range of 190° C. to 220° C., preferably about 200° C., and a pressure of 500 to 4,000 psig, preferably about 2,000 psig. The polyol precursor is fed into the reactor at a flow rate from about 0.1 to 1.0 grams per cubic centimeter of catalyst per hour. Ammonia is fed into the reactor at a rate of about 0.2 to 6.0 lbs. per pound of polyol. Hydrogen is fed into the reactor at a flow rate of about 1 to 10 standard cubic feet per pound of polyol. The reactor effluent is stripped at about 85° C. to 175° C., under 0.1 to 150 mm of mercury Hg to obtain the random backbone polyoxyalkylene diamine reactant.

The imide reaction product of the invention is prepared by reacting from about 1.5 to 2.5 moles of the prescribed hydrocarbyl-substituted dibasic acid anhydride with a mole of the prescribed random backbone polyoxyalkylene diamine reactant. This is generally done at a temperature ranging from 30° C.–200° C., preferably at a temperature from about 90° C. to about 150° C. until all the water formed in the reaction has been removed. Normally, the reaction is carried out in the presence of a solvent, and a preferred solvent is one which will azeotrophically distill with water. Suitable solvents include hydrocarbons boiling in the gasoline boiling range of about 30° C. to about 200° C. Specific suitable hydrocarbon solvents include hexane, cyclohexane, benzene, toluene, and mixtures thereof. Toluene is a preferred solvent for the reaction. When the imide reaction has been completed, the reaction product can be separated from the solvent using conventional means or it may be left in admixture with some or all of the solvent for blending in the motor fuel composition.

The following preparation is typical of the method for making the random backbone imide reaction product of the invention:

Ten pounds of a polyethylene glycol of an approximate molecular weight of 600 and 100 grams of 45% aqueous KOH were charged into a 10-gallon reactor, which was then purged with prepurified nitrogen. While maintaining a nitrogen purge, the reactor was heated to about 100° C. and the initiator was then dried to a water content of less than 0.1% by vacuum stripping followed by nitrogen stripping. Thereafter, approximately 5 lbs. of ethylene oxide and about 26.2 lbs. of propylene oxide were slowly charged and reacted at 105° C. to 110° C. and about 50 psig over a 1–4 hour period.

After a two-hour digestion period, the alkaline random backbone polyol was neutralized by stirring for two hours with 360 grams of MAGNESOL 30/40, which was added as an aqueous slurry. To stabilize the material, 26.4 grams of di-t-butyl p cresol was added. The neutralized product was then vacuum stripped to about 5 mm Hg pressure, nitrogen stripped and filtered to produce the random backbone polyol.

0.6 lb/hr of the random backbone polyol, 1.2 lb/hr of ammonia, and 36 liter/hr of hydrogen were fed into a 1,250 mi tubular reactor filled with a nickel-chromium-copper metal and metal oxide catalyst which was kept at 200° C. and 2,000 psig. The reactor effluent was stripped at 100° C. and 10 mm Hg vacuum to produce a random backbone polyoxyalkylene diamine. The random polyoxyalkylene diamine was of the formula:

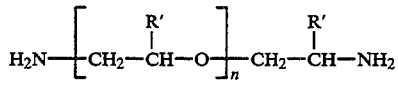

in which R′ represented hydrogen and a methyl radical and the weight percent of ethylene oxide in the polyoxyalkylene radical was about 25–30 percent and n had a value of about 4–5.

Two parts of polyisobutenyl (1300 M.W.) succinic acid anhydride (prepared by reacting maleic anhydride and INDOPOL H-300), 4 parts of xylene, and 1 part of the random backbone polyoxyalkylene diamine prepared above were reacted at a temperature of about 90° C. to 180° C. until no more water could be removed from the system. The reaction product was then filtered and stripped of remaining solvent under vacuum and identified by IR, NMR, and elemental analysis. (Alternatively, the preparation of the bisimide can take place in the absence of the solvent (xylene). The absence of solvent decreases the reaction time from 8–10 hours to 2–4 hours and eliminates the solvent removal step.)

The following examples give the details of specific additive embodiments of the invention.

EXAMPLE I

Example I was prepared in the manner described in the preparation above to produce the bisimide reaction product of a polyisobutenyl (1300 M.W.) succinic acid anhydride and a random backbone polyalkylene diamine represented by the formula:

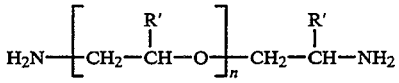

in which R′ represents hydrogen and a methyl radical and the random polyoxyalkylene backbone radical contained about 7 weight percent ethylene oxide and 93 weight percent propylene oxide.

EXAMPLE II

Example II is similar to Example I, except that a higher mole percent of R′=hydrogen was employed with the result that the random backbone radical in the polyoxyalkylene diamine contained 15 weight percent of ethylene oxide and 85 weight percent of propylene oxide.

EXAMPLE III

This example is similar to Example I above, except that the random backbone radical in the polyoxyalkylene diamine contained 25 weight percent of ethylene oxide and 75 weight percent of propylene oxide.

EXAMPLE IV

This example is similar to Example I, except that the random backbone radical in the polyoxyalkylene diamine reactant contained 40 weight percent of ethylene oxide and 60 weight percent of propylene oxide.

EXAMPLE V

This example is similar to Example I, except that the random backbone radical in the polyoxyalkylene diamine reactant contained 70 weight percent of ethylene oxide and 30 weight percent of propylene oxide.

EXHIBIT I (Comparative)

This comparative exhibit is of a commercial bisimide reaction product prepared similarly to Example I, except that the polyoxyalkylene diamine reactant was formed from a polyoxyalkylene block copolymer radical consisting of 50 weight percent of an ethylene oxide block copolymer radical, 45 weight percent of two propylene oxide block copolymer radicals, and 5 weight percent of two butylene oxide block copolymer radicals.

The additive of the invention was mixed in a blending package which was then employed for preparing the fully formulated motor fuel composition.

A representative blending package for the experimental random and block bis-succinimides is provided in the following table:

TABLE 1

| Component | Amount (ptb) |
|---|---|
| Experimental bisimide (active) | 15 |
| Commercial detergent | 100 |
| Fluidizer | 100 |
| Solvent | 157 |
| Commercial dehazer | 5 |

The performance of the random backbone bisimide additive of the invention and of a commercial motor fuel additive which is the bisimide formed from a polyisobutenyl (1300 M.W.) succinic acid anhydride and a block copolymer polyalkylene diamine containing approximately 50 weight percent ethylene oxide block polymer radical, the remainder being substantially propylene oxide block polymer radical formulated in a blending package as described above was determined in a water tolerance test. 0.14 weight percent of the blending package was added to the motor fuel composition. This amount contributed about 377 (PTB) pounds of additive per 1000 barrels of gasoline for the experimental random backbone oligomer bisimide additive and for the commercial block copolymer bisimide additive.

The tolerance test was conducted by adding 90 milliliters of the test motor fuel and 10 milliliters of water to a graduated cylinder. The mixture was thoroughly shaken up and then allowed to stand for 24 hours. The appearance of the blends was observed and reported on after 1 hour, 4 hours, and 24 hours. The test results are set forth in the table below. Additionally, FIG. 1 photographically illustrates the results of the test after the blends had rested for four hours.

TABLE 2

| Component Description | Exhibit 2 | 3 | 4 | 5 | 6 | 1 |
|---|---|---|---|---|---|---|
| Ethylene Oxide, wt. % | 7 | 15 | 25 | 40 | 60 | 50 |
| Propylene Oxide, wt. % | 93 | 85 | 75 | 60 | 40 | 4s |
| Butylene Oxide, wt. % | — | — | — | — | — | 5 |
| 1 hour | | | | | | |
| Gasoline layer: | 77 | 73 | 74 | 63 | 67 | 85 |
| Water layer: | 3 | 3 | 3 | 3 | 3 | 3 |
| % Emulsion at Interphase: | 7 | 7 | 2 | 7 | 50 | 100 |
| 4 hours | | | | | | |
| Gasoline layer: | 90 | 89 | 86 | 76 | 87 | 95 |
| Water layer: | 3 | 3 | 3 | 3 | 3 | 4 |
| % Emulsion at Interphase: | 7 | 7 | 2 | 7 | 40 | 100 |
| 24 hours | | | | | | |
| Gasoline layer: | 98 | 98 | 98 | 98 | 98 | 98 |
| Water layer: | 2 | 2 | 2 | 3 | 3 | 4 |
| % Emulsion at Interphase: | 2 | 2 | 1 | 7 | 20 | 100 |
| Invert + 1 hour | | | | | | |
| Gasoline layer: | 81 | 81 | 86 | 53 | 68 | 84 |
| Water layer: | 2 | 2 | 2 | 2 | 3 | 4 |
| % Emulsion at Interphase: | 2 | 2 | 2 | 2 | 3 | 100 |

Rating System -

| | |
|---|---|
| Gasoline Layer: | The gasoline layer was rated by using a Brinkmann Haze meter. The haze meter values range from 0 to 100; 100 is perfectly clear gasoline. |
| Water Layer: | The water layer is visually rated using the following notations:<br>1 = clear<br>2 = cloudy<br>3 = some emulsion<br>4 = all emulsion |
| Emulsion Interphase: | The emulsion interphase is visually rated by determining percent emulsion at the gasoline/water interphase. |

An Octane Requirement Increase evaluation test was performed using the experimental random backbone bis-succinimides of Examples I to V, which corresponded to Exhibits 2 to 6, respectively, blended in a fuel package as described above using a 1.8 L Chevy engine. After 200 hours of testing, the octane appetite of these fuels were statistically indistinguishable from results obtained using a commercial ORI-inhibited motor fuel composition.

The new random backbone bisimide reaction product of the invention has exhibited substantially improved water tolerance properties in reducing haziness and in reducing emulsion formation in formulated motor fuel compositions that come in contact with water. This new additive has also surprisingly been found effective as an ORI-inhibitor which has not heretofore been demonstrated for a random backbone copolymer additive.

What is claimed is:

1. An imide composition obtained by reacting, at a temperature of 30° C.–200° C.:

(a) a hydrocarbyl-substituted dibasic acid anhydride of the formula:

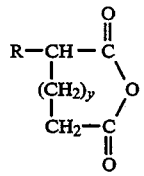

where R is a hydrocarbyl radical having a molecular weight range of 500–3,500 and y has a value of 0–2; and (b) a random backbone polyoxyalkylene diamine of the formula:

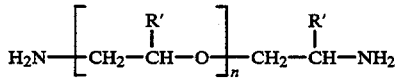

in which R′ represents hydrogen or an alkyl radical having from 1 to 2 carbon atoms and the backbone polyoxyalkylene radical consists of from about 5 to 65 weight percent of ethylene oxide and n has a value from 5 to 200.

2. A composition according to claim 1 in which said random backbone polyoxyalkylene radical consists of from about 10 to 50 weight percent of ethylene oxide.

3. A composition according to claim 1 in which said random backbone polyoxyalkylene radical consists of from about 10 to 40 weight percent of ethylene oxide.

4. A composition according to claim 1 in which R′ represents hydrogen and a methyl radical.

5. A composition according to claim 1 in which n has a value from 10 to 100.

6. A composition according to claim 1 in which R is a polypropenyl or polybutenyl radical having molecular weight in the range of 500 to 2,500.

7. A composition according to claim 1 in which R has a molecular weight range from about 600 to 1,500.

8. A composition according to claim 1 in which said hydrocarbyl-substituted dibasic acid anhydride reactant is a hydrocarbyl-substituted maleic anhydride.

9. A composition according to claim 1 in which about 2 moles of said hydrocarbyl-substituted dibasic acid anhydride are reacted with a mole of said random backbone polyoxyalkylene diamine.

10. A motor fuel composition comprising a mixture of hydrocarbons in a gasoline boiling range and from about 0.0005 to 1 weight percent of the bisimide reaction product of claim 1.

11. A composition according to claim 1 obtained by reacting said dibasic acid anhydride with said random backbone polyoxyalkylene diamine at a temperature in the range of 30° C.–200° C.

12. A composition according to claim 11 in which said reaction is conducted at a temperature ranging from about 90° C.–150° C.

13. A motor fuel composition comprising a mixture of hydrocarbons in the gasoline boiling range containing from about 0.0005 to 1 weight percent of an imide composition obtained by reacting:

(a) a hydrocarbyl-substituted dibasic acid anhydride of the formula:

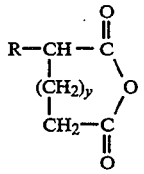

where R is a hydrocarbyl radical having a molecular weight range of 500–3,500 and y has a value of 0–2; and (b) a random backbone polyoxyalkylene diamine of the formula:

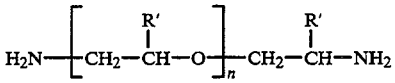

in which R′ represents hydrogen or an alkyl radical having from 1 to 2 carbon atoms and the random backbone polyoxyalkylene radical consists of from about 5 to 65 weight percent of ethylene oxide and n has a value from 5 to 200.

14. A motor fuel composition according to claim 13 containing said imide composition in the range from about 0.001 to 0.2 weight percent.

15. A motor fuel composition according to claim 14 containing said imide composition in a concentration ranging from about 0.005 to 0.1 weight percent.

* * * * *